US005426493A

United States Patent [19]

Oyler

[11] Patent Number: 5,426,493

[45] Date of Patent: Jun. 20, 1995

[54] REMOVABLE LID APPARATUS FOR TONER CARTRIDGE AND METHOD OF USE

[75] Inventor: Jeffrey B. Oyler, San Antonio, Tex.

[73] Assignee: National Laser Technologies, Inc., San Antonia, Tex.

[21] Appl. No.: 231,392

[22] Filed: Apr. 22, 1994

[51] Int. Cl.[6] ..... G03G 21/12

[52] U.S. Cl. ..... 355/260; 355/200

[58] Field of Search ..... 355/260, 245, 210, 200; 118/653; 222/DIG. 1

[56] References Cited

U.S. PATENT DOCUMENTS

| | | | |
|---|---|---|---|
| 4,373,468 | 2/1983 | Suda | 118/658 |
| 4,460,267 | 7/1984 | Ogawa . | |
| 4,615,608 | 10/1986 | Mizutani . | |
| 4,816,877 | 3/1989 | Keen | 355/133 |
| 4,862,210 | 8/1989 | Woolley | 355/245 |
| 4,870,463 | 9/1989 | Miyoshi | 118/653 |
| 4,989,044 | 1/1991 | Nishimura | 355/251 |
| 5,080,745 | 1/1992 | Paull | 156/247 |
| 5,110,646 | 5/1992 | Prestal | 428/43 |
| 5,134,960 | 8/1992 | Shirai | 118/653 |
| 5,175,587 | 12/1992 | Kato et al. | 355/260 |
| 5,185,616 | 2/1993 | Wilcke | 355/260 |
| 5,223,068 | 6/1993 | Baley | 156/250 |
| 5,267,003 | 11/1993 | Grappiolo | 355/260 |
| 5,331,381 | 7/1994 | Ota et al. | 355/260 |
| 5,337,125 | 8/1994 | Nakano et al. | 355/260 |

*Primary Examiner*—R. L. Moses

*Attorney, Agent, or Firm*—Novak, Druce, Herrmann & Burt

[57] ABSTRACT

A removable lid assembly for covering the access opening of a blade housing segment of a Canon developer cartridge wherein the blade housing segment has a cavity therein which intersects with the access opening and contains a cleaning blade and a series of spaced, but transverse, flat web-like members which are arranged to support the cleaning blade. The lid assembly includes an elongated, generally planar member which has portions thereon that define an elongated recess along one edge portion thereof into which a peripheral edge portion which defines the access opening is inserted. A number of spaced, thickened members are fastened in the cavity of the blade housing. Each or the thickened members is provided with a bore, and has portions thereon which define a slot in which one of the transverse web-like members extends to locate and space the thickened members within the cavity. The planar member is provided with a number of spaced holes through which a number of screws extend to engage the bores of the thickened members, thus removably attaching the planar member to the thickened members. The slots in the thickened members and the transverse web-like members cooperate to align the thickened members below the holes in the planar member such that the bores of the thickened members intersect with the holes in the planar member. A seal along the peripheral edge of the planar member seals against the blade housing when the planar member is attached to the thickened members.

22 Claims, 7 Drawing Sheets

REMOVABLE LID APPARATUS FOR TONER CARTRIDGE AND METHOD OF USE

BACKGROUND OF THE INVENTION

1. Field of Invention

This invention relates generally to toner cartridges for laser printers and photocopying machines, and in particular to removable lid apparatus usable during the toner recharging process to cover the access opening of the blade housing segment of the cartridge so that the cartridge becomes reusable.

2. Description of the Background

Toner cartridges used in electro photographic copiers are structured quite differently from each other, depending on the particular machine in which the cartridge is intended for use. Further, many toner cartridges are intended for a single use, and the used cartridge is to be discarded after the toner is depleted. Commonly, to resolve toner leakage problems, toner cartridges include a toner hopper, a seal assembly, a mounting member, a roller assembly, a drum assembly and a corona assembly. Unfortunately, this arrangement is expensive, and many components of the cartridge are still usable after the toner has been expended. Consequently, many portions of the toner cartridge are configured so that they may be reused. However, if other portions of the used cartridge may be reused on a regular basis, more structural resources can be preserved and operating costs can be lowered.

U.S. Pat. No. 4,862,210 describes such a replaceable seal assembly for modifying and recharging a used Canon toner cartridge of the type having an upper toner reservoir and a lower roller housing joined along its common edges with the toner reservoir housing and separated therefrom by an original toner reservoir seal, which is removed when the cartridge is placed into use. Originally, the entire developer cartridge was intended to be thrown away, but the modification provides a replaceable seal assembly wherein an elongated, rigid seal member can be inserted longitudinally into a peripheral recess formed between the toner reservoir and the lower roller housing, thus allowing the cartridge to be refilled and reused on a regular basis. Pat. No. 5,223,068 describes method and apparatus wherein a table saw is used to separate the toner hopper from a mounting member, and a hand held plane is utilized to prepare facing gasket surfaces on the toner hopper and the mounting member, wherein a new seal assembly, comprising a gasket and a folded seal member, is glued between the hopper and the mounting member to seal the discharge opening. A portion of the folded seal member forms a tab, which when pulled, allows the seal member to be removed from the gasket, uncovering the discharge opening and placing the cartridge in use. U.S. Pat. No. 5,110,646 discloses a reconditioned toner cartridge, which when deployed for use, the user pulls a perforated center strip from under the magnetic roller housing, thus exposing the toner and energizing the cartridge for use. U.S. Pat. No. 4,816,877 discloses a refillable toner cartridge wherein the toner hopper is provided with a refill hole which is covered by a washer over which a seal member having an adhesive layer is attached; and wherein the discharge holes of the waste toner hopper chamber are covered by a seal member, which has an adhesive layer and which may be made of a permeable material to permit air to pass through, and not toner particles so that the cartridge can be forwarded by air transport. U.S. Pat. No. 4,870,463 discloses another toner cartridge wherein the seal element extension is pulled to strip the sealing portion of the sealing member from the lower surface of the toner box, thus opening the lower surface of the toner box.

However, the Canon toner cartridge assembly described in U.S. Pat. No. 5,134,960 is different. The Canon toner cartridge assembly described therein includes an upper, blade housing segment, which contains a cleaning blade that wipes against the photosensitive member to remove residual developer remaining on the photosensitive member after image transfer, which is retained within the cavity of the blade housing. Originally, the cavity of the blade housing segment is provided with an access opening, over which a rigid plastic cover piece is glued, and which remains in place while the cartridge is placed in service. However, in order to remanufacture or refurbish the toner cartridge, the cleaning blade may need servicing, and the cavity of the blade housing may need cleaning to remove the residual developer. Consequently, in order to gain access to the cleaning blade and the cavity of the blade housing, the plastic cover piece must be broken loose from its engagement with the blade housing. Ordinarily, the cover piece may break, and when removed, the peripheral sealing area depression which surrounds the access opening is left in a toughened state. In the past, some users have tried to recover the access opening with a piece of tape, but this has not been found to be entirely satisfactory because of leakage. Others obtain a new blade housing and discard the old blade housing, which is expensive and wasteful. Therefore, there is a need for a seal arrangement which allows the original blade housing to be reused on a regular basis.

SUMMARY OF INVENTION

Therefore, it is a primary aim of the present invention to provide novel, removable lid apparatus which covers the access opening of a blade housing segment of a Canon developer cartridge of the type having a blade housing segment which contains an elongated cleaning blade and which has a cavity therein, wherein removal of the lid portion of the present invention, which covers the access opening, allows access to the cavity of the blade housing segment for cleaning and servicing the cleaning blade. In accordance with this aim, the removable lid apparatus of the present invention provides an elongated, generally planar cover member, which has portions thereon defining an elongated recess along one edge portion thereof into which a peripheral edge portion defining the access opening is inserted, and which is rotated downward and fastened over the access opening. In order to facilitate downward rotation of cover member downward over the access opening, the recess is provided with a shaped cross section which facilitates rotating the cover member downward over the access opening. The shaped cross section may be defined by a pair of intersecting surfaces, which intersect at an obtuse angle to form a recess having a wider entrance, and which narrows as the recess approaches its enclosed end.

Another aim of the present invention is to provide novel fastening means for removably fastening the cover member over the access opening of the blade housing segment In accordance with this aim, a plurality of spaced, thickened members are fastened within the cavity of the blade housing. Spaced fasteners releasingly engage the thickened members to removably fasten the cover member over the access opening In one embodiment, the thickened members may be provided in the form of elongated, wedge shaped blocks, each of which has portions thereon defining a slot in which one of the transverse, flat web-like members located in the cavity of the blade housing extends to locate and space the wedge shaped blocks within the cavity such that the wedge shaped blocks are positioned below the fasteners. In this embodiment, the slots in the wedge shaped blocks, together with the transverse web-like members disposed in the cavity of the blade housing cooperate to align the wedge shaped blocks below the fasteners. In another embodiment, the thickened member may be provided in the form of a plurality of post portions, which are located, and spaced within the cavity of the blade housing below the fasteners. In this embodiment, the post portions are provided with angular, flattened lower surfaces which abut against the bottom of the cavity of the blade housing, and which allow the posts to be arranged within the cavity generally perpendicular to the cover member.

Another novel embodiment of the removable lid apparatus according to the present invention provides an elongated, generally planar member, which includes an elongated skirt which extends generally transversely downward from, and across the bottom side of the cover member, and which is arranged to contact against an interior sidewall portion defining the cavity of the blade housing segment such that when the skirt is fastened to the interior sidewall portion of the blade housing segment, the cover member is removably fastened over the access opening. A further novel embodiment of the removable lid apparatus according to the present invention provides an elongated, generally planar member, which includes an elongated skirt which extends angularly upward from the rearward peripheral edge of the cover member, generally at an obtuse angle, and which is arranged to contact against the rearward lip of the blade housing segment such that when the skirt is fastened to the lip portion of the blade housing segment, the cover member is removably fastened over the access opening.

The removable lid apparatus according to the present invention therefore permits the blade housing segment of the Canon developer cartridge to be reused on a regular basis, which conserves resources and reduces the cost of refurbishing the developer cartridge. During refurbishing or remanufacture of the cartridge, the removable lid apparatus according to the present invention permits easy access to the cavity of the blade housing for cleaning, and servicing the cleaning blade disposed within the cavity of the blade housing. Therefore, the blade housing segment will not need to be discarded, or need continual extensive repairs to the sealing area depression, which surrounds the access opening. Once in place the removable lid apparatus remains in place until the supply of toner is exhausted, at which time the cartridge can be refurbished.

DESCRIPTION OF THE PREFERRED EMBODIMENTS

Figure 1:
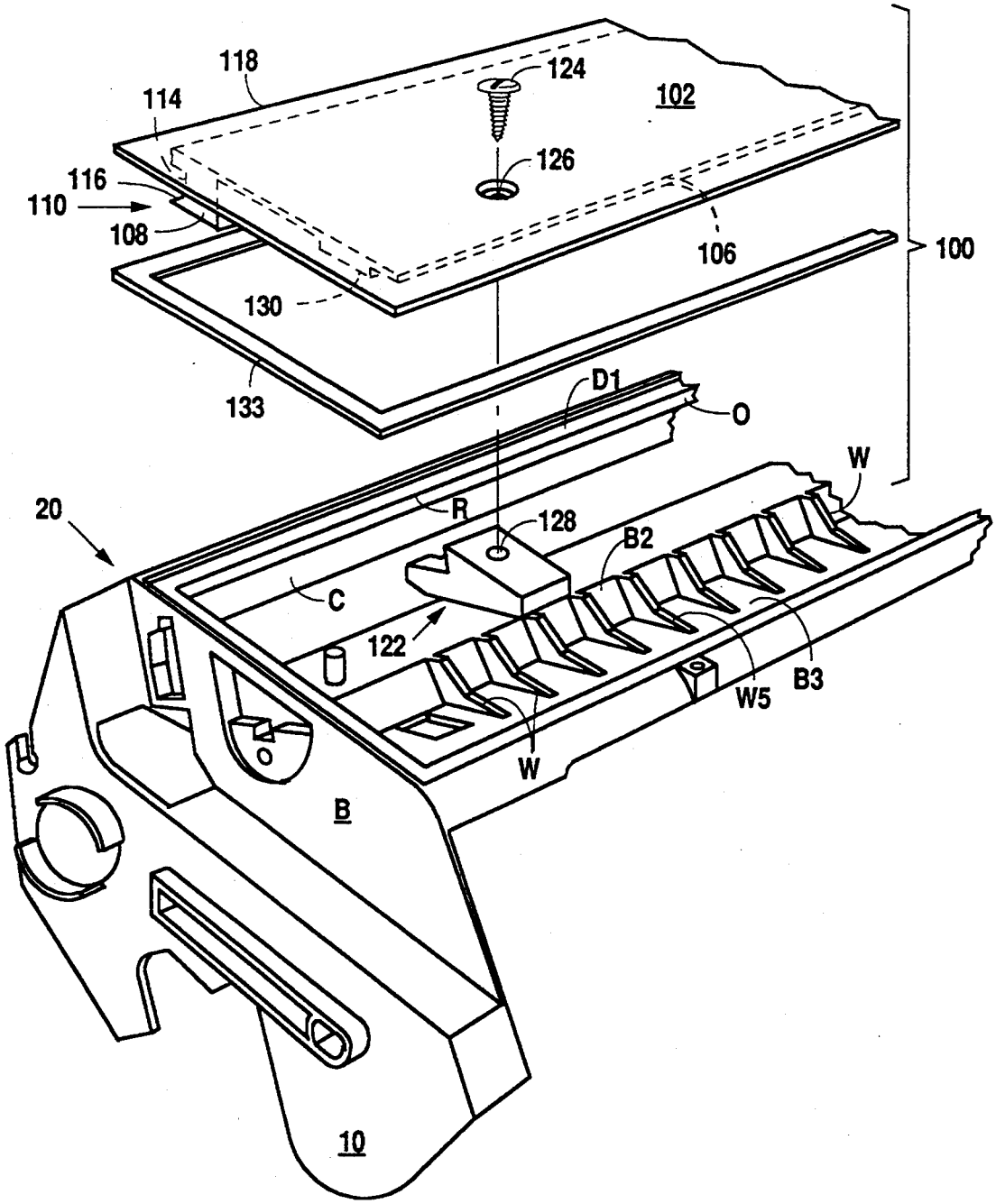
FIG. 1 is an exploded pictorial view illustrating removable lid apparatus according to the present invention.
Figure 2:
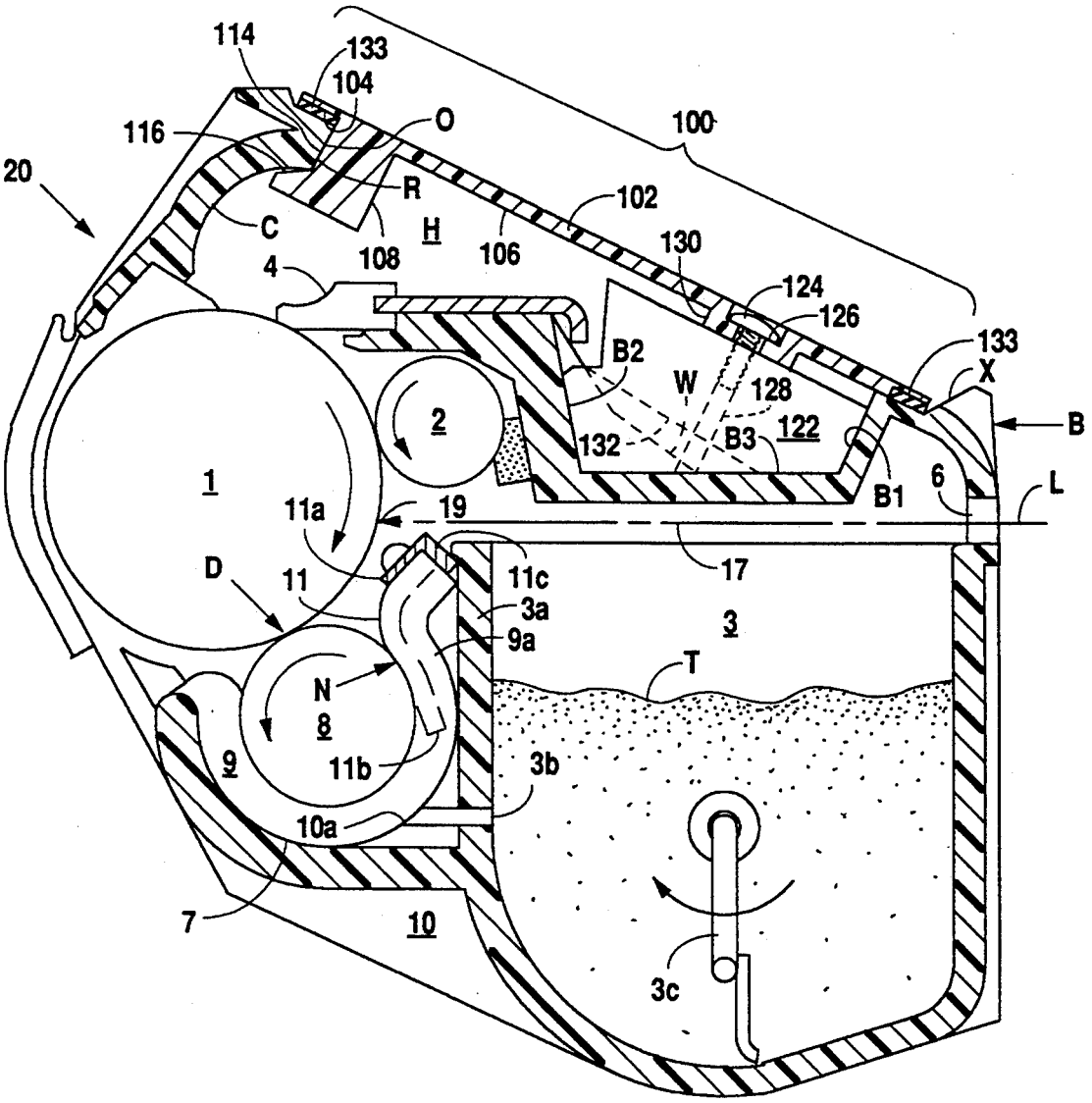
FIG. 2 is a cut-away side view showing the removable lid apparatus embodiment illustrated in FIG. 1 covering the access opening of the blade housing segment of the toner cartridge.

Referring to FIG. 1, an embodiment of the removable lid assembly of the present invention is illustrated generally as 100. Removable lid assembly 100 is developed especially for use in a used developing cartridge or process unit 20, described in U.S. Pat. No. 5,134,960, the details of which are incorporated herein, and which is described briefly hereafter, utilizing similar reference numbers to the extent provided by the description and drawings. Referring to FIG. 2 for details, process unit 20 comprises, in part, a frame 10; a blade housing segment B extending across the upper portion of frame 10, a developer container 3; and a developer supply chamber 7.

Developer container 3 is separated from developer container 3 by a partition wall 3*a*. Developers container 3 and developer supply chamber 7 are carried by frame 10. An outlet port 3*b* connects developer container 3 to developer supply chamber 7. Located in developer container 3 is a rotatable developer conveying member 3*c*. Rotatable developer conveying member 3*c* is arranged to convey premixed, developer-toner, termed developer T, from developer container 3 through outlet port 3*b* into developer supply chamber 7. Developer container 3 is carried on frame 10, in a spaced relationship below blade housing segment B to define a path therebetween.

Disposed within developer supply container 7 is a rotatable developing sleeve 8. Carried near, but spaced from rotatable developing sleeve 8 is a rotatable electrophotographic photosensitive member 1. Rotatable electrophotographic photosensitive member 1 is carried in a forward portion of frame 10, generally between blade housing segment B and developer supply chamber 7. Located in a rear portion of frame 10 is a slitlike exposure window 6. The path between blade housing segment B and developer supply chamber 7 connects with slitlike exposure window 6, and provides an optical path 17 that connects With photosensitive member 1.

Blade housing segment B is provided with an access opening O, which intersects with the hollow cavity H of blade housing segment B, and as originally manufactured, an original access opening seal, not illustrated in the Figures. Facing cavity H, a rearward facing, peripheral edge portion R defining a portion of access-opening O is provided with an inward facing, concave cross section C. A cleaning blade 4 is located in cavity H of blade housing segment B. A series of spaced, but transverse, flat web-like members W, best seen in FIG. 1, extend upward from the bottom B3 of cavity H. Web-like members W are arranged to support cleaning blade 4. Web-like members W support cleaning blade 4 in a spaced arrangement above bottom B3 of cavity H such that the forward peripheral edge of cleaning blade 4 contacts against photosensitive member 1. Access opening O, when uncovered, gives access to cavity H for cleaning residual developer from blade housing segment B, and removing and replacing cleaning blade 4.

A rotatable chargers 2 carried by frame 10 is provided for charging photosensitive member 1, wherein by the projection of a laser beam L, which travels along optical path 17, an electrostatic latent image is formed on photosensitive member 1. The peripheral edge of cleaning blade 4 contacts against photosensitive member 1 to remove residual developer remaining on photosensitive member 1 after image transfer, which is retained within cavity H after removal.

In addition, a developer amount regulating blade 11 carried on partition wall 3*a* extends into developer supply container 7. Regulating blade 11 contacts against developing sleeve 8 to regulate the thickness of the layer of the developer applied on developing sleeve 8. The uniform distance between regulating blade 11 is Such that the thickness of the layer is less than the minimum clearance between photosensitive member 1 and developing sleeve 8.

Access opening O was originally covered, as manufactured, by the original access opening seal. The original access opening seal was provided in the form of a flat, rectangular rigid plastic coveting, which was glued or bonded in place over access opening O. The original access opening seal prevented residual developer from leaking through access opening O while process unit 20 was in use and when process unit 20 is removed from the electrophotographic copying machine or electrophotographic laser beam printer. When process unit 20 is removed for servicing, the original access opening seal must be broken free from its glued connection to blade housing segment B in order to service Cleaning blade 4 and clean residual developer from hollow cavity H. Ordinarily, this leaves a roughened edge in the peripheral sealing area depression D1, which surrounds access opening O. To the extent possible, this roughened edge is smoothed, but some roughness ordinarily remains. Often, the original access opening seal is broken when it is detached from its glued connection to blade housing segment B.

Figure 3:
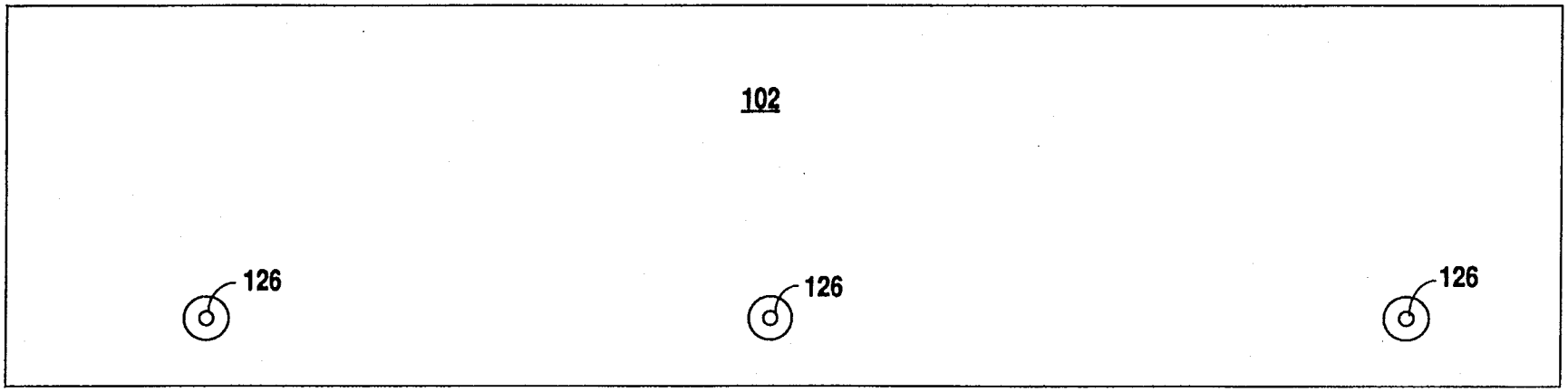
FIG. 3 is a top view of the removable lid illustrated in FIG. 1.
Figure 6:
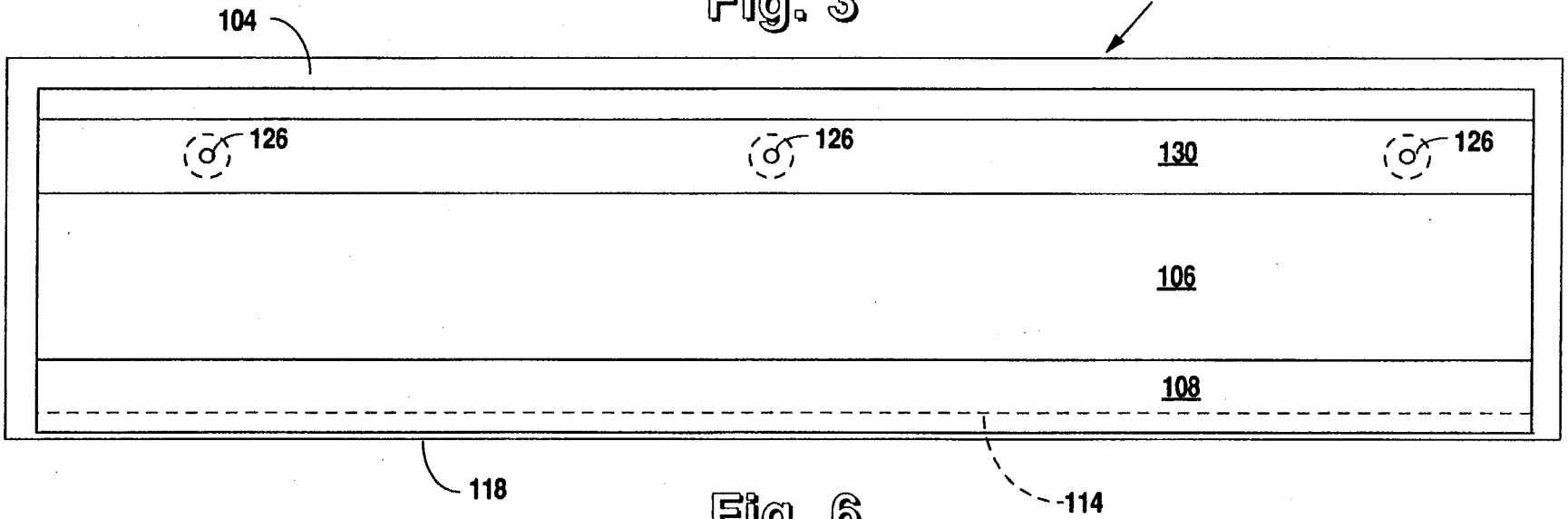
FIG. 6 is a bottom view of the removable lid illustrated in FIG. 1.

As illustrated in FIGS. 1–2, removable lid assembly 100 is utilized to cover access opening O, once the original access opening seal is detached from its connection to blade housing segment B. Of course, it is within the scope of the invention that removable lid assembly 100 may be utilized during the manufacture of the original process unit 20. Removable lid assembly 100 comprises an elongated, generally planar member 102. Planar member 102 preferably comprises a generally rigid, thin member, which may be molded or formed or cut from a sheet of a suitable plastic such as polycarbonate. As illustrated in FIGS. 3 and 6, planar member 102 may be provided with upper and lower flattened surfaces. Of course, ridges, ribs or the like may be formed along one or both surfaces of planar member 102 to increase the rigidity of planar member 102. Given the dimensions of peripheral sealing area depression D1 surrounding access opening O, the dimensions of the generally rigid planar member 102 should be approximately equal to the following values: length 9 13/16 inches (24.924 centimeters), width 2 13/32 inch (6.112 centimeters), and ⅛ inch (0.318 centimeter) thickness. For the purposes of illustration only, these values have been greatly distorted in the Figures.

Referring to FIG. 6, the lower surface of planar member 102 is provided with a peripheral, generally rectangularly shaped recess 104, defined by rectangularly shaped land 106. Generally, the dimensions of recess 104 are as follows: width approximately 3/16 inches (0.476 centimeter), and depth approximately 1/16 inches (0.159 centimeter).

Figure 4:
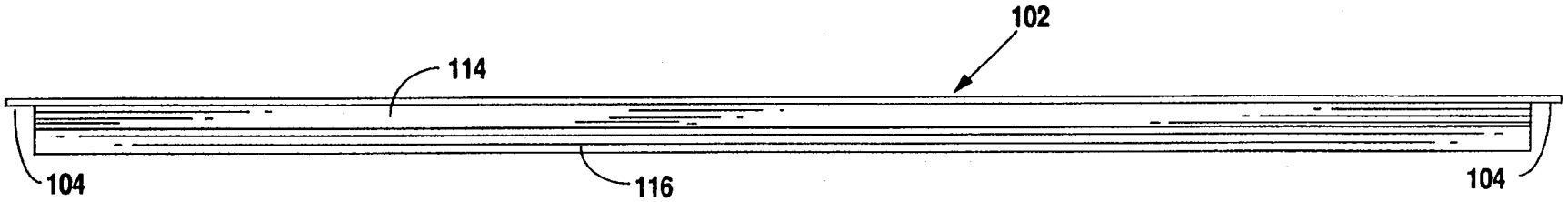
FIG. 4 is a front, side view of the removable lid illustrated in FIG. 1.
Figure 10:
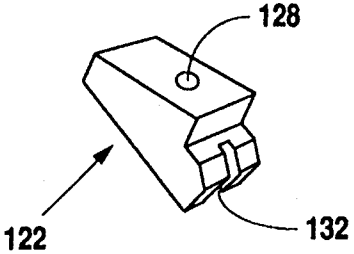
FIG. 10 is a pictorial, detail view of the wedge shaped block illustrated in FIG. 1.
Figure 9:
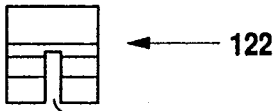
FIG. 9 is a front-end, detail view of the wedge shaped block illustrated in FIG. 1.
Figure 7:
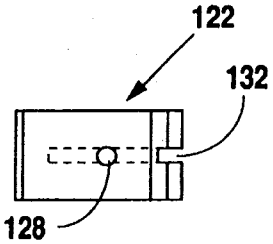
FIG. 7 is a top, detail view of the wedge shaped block illustrated in FIG. 1.
Figure 8:
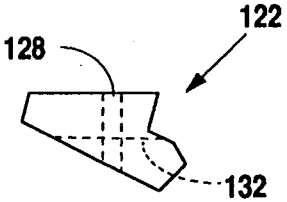
FIG. 8 is a side, detail view of the wedge shaped block illustrated in FIG. 1.
Figure 5:
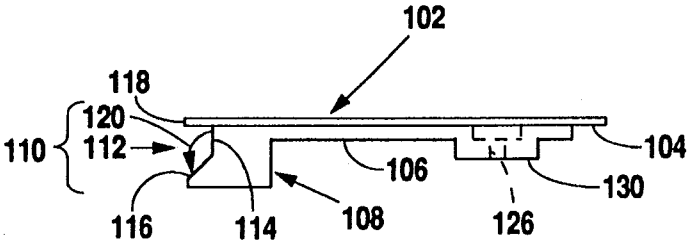
FIG. 5 is an end view of the removable lid illustrated in FIG. 1.

An elongated prop member portion 108 extends along the forward, longitudinal side of land 106 next to recess 104. Prop member 108 may be attached to land 106 by suitable means such as heat bonding or gluing, or formed integral with planar member 102 by suitable means such as molding. Referring to FIGS. 4 and 5, an elongated recess 110 is formed between planar member 102 and prop member 108. Referring to FIGS. 2 and 5, recess 110 has a shaped cross section 112 into which rearward facing, peripheral edge portion R defining a portion of access opening O is inserted. Shaped cross section 112 facilitates rotating planar member 102 downward over access opening O. Shaped cross section 112 is defined by a pair of intersecting, elongated, flattened surfaces 114, 116. Generally, flattened surfaces 114, 116 intersect at an obtuse angle to provide recess 110 with a wide entrance, and a narrower enclosed end.

Transverse flattened surface 114 is inset from, and generally parallels the forward longitudinal edge 118 of planar member 102. Transverse flattened surface 114 extends generally transversely from, and across the lower surface of planar member 102. As best illustrated in FIG. 4, transverse flattened surface 114 extends across a portion of the length of land 106, and as illustrated, transverse flattened surface 114 may extend longitudinally over the longitudinal length of land 106.

Referring again to FIG. 5, angular flattened surface 116 is spaced below the lower surface of planar member 102. Angular flattened surface 116 intersects transverse flattened surface 114 at an obtuse angle 120, such as 135 degrees. As may be appreciated, obtuse angle 120 aids in inserting peripheral edge portion R into recess 110. As best illustrated in FIG. 4, angular flattened surface 116 extends across a portion of the length of land 106, and as illustrated, transverse flattened surface 114 may extend longitudinally over the length of land 106, When removable lid assembly 100 is utilized to recover access opening O, rearward facing, peripheral edge portion R defining a portion of access opening O is inserted into recess 110. Rearward facing peripheral edge portion R is provided with a concave cross section C, which faces cavity H. As rearward facing, peripheral edge portion R is inserted into recess 110, angular flattened surface 116 mates generally against concave cross section C. As planar member 102 is rotated downward to cover access opening O, intersecting surfaces 114, 116 pivot about edge portion R. Recess 110 is therefore provided with a shaped cross section 112, which facilitates rotating planar member 102 downward over access opening O.

Fastening means are provided adjacent the side of planar member 102 opposite elongated recess 104 for removably fastening planar member 102 to blade housing segment B. Referring to the embodiment illustrated in FIGS. 1–2 and 7–10, fastening means includes a plurality of thickened members which may be provided in the form of wedge shaped blocks 122, and a plurality of fasteners, which may be provided in the form of screws 124, and which extend through a plurality of spaced, counterbored holes 126 formed in planar member 102, to engage bores 128 in wedge shaped blocks 122. As best indicated in FIGS. 3 and 6, the number of blocks 122, screws 124 and counterbored holes 126 may be three, although other numbers of blocks 122, screws 124, and holes 126 such as two may be provided instead. Counterbored holes 126 receive the heads of screws 124, so that planar member 102 is provided with a flush surface. As best illustrated in FIGS. 5 and 6, planar member 102 may be provided with an elongated spacer strip 130 which extends along land 106, and which may be formed by extrusion molding. As illustrated, spaced holes 126 extend through spacer strip 130, which fills any gap between formed between blocks 122 and planar member 102, thus reducing the thickness of planar member 102. Referring to FIG. 2, wedge shaped blocks 122 are provided with a complimentary cross section which mates between angled sidewalls B1, B2 and bottom B3, which together define a large portion of cavity H.

Referring to FIGS. 7–10 for details, the forward facing end portion of each wedge shaped block 122 is provided with an angular slot 132. Slots 132 cooperate as follows with web-like members W to allow wedge shaped blocks 122 to be easily positioned in cavity H such that bores 128 are aligned below holes 126. Referring to FIG. 1, and counting from the end of cavity H, the angular slot 132 of each wedge shaped block 122 is aligned over, for example, the fifth web-like member W5. Once positioned, each wedge shaped block 122 is slid downward until the lower face of wedge shaped block 122 contacts against bottom B3, as illustrated in FIG. 2.

As each wedge shaped block 122 moves downward, the corresponding web-like member W5 slides into slot 132, and wedge shaped blocks 122 are accordingly spaced within cavity H with their bores 128 aligned below holes 126 in planar member 102. In this manner, web-like members W and slots 132 cooperate to align thickened members 122 below holes 126, so that fasteners in the form of screws 124 may engage bores 128 in wedge shaped blocks 122. Wedge shaped blocks 122 may be attached or bonded within cavity H to blade housing segment B by suitable means such as gluing or heat bonding. Once wedge shaped blocks 122 are attached to blade housing segment B, screws 124 may engage bores 128 to removably fasten planar member 102 over access opening O. Web-like members W5, which extend into slots 132, assist in preventing the bond between wedge shaped blocks 122 and blade housing segment B from being broken as screws 124 are tightened.

Seal means provided in the form of a lightweight foam seal member 133 is disposed in peripheral recess 104, which extends along the peripheral edge of planar member 102. Given the dimensions of peripheral recess 104, the dimensions of Seal member 133 should be approximately equal to the following values: generally 0.157 inches (4 millimeters) wide and $\frac{1}{8}$ inch (0.049 centimeters) thick. As screws 124 are tightened, planar member 102 compresses seal member 133 in sealing area depression D1. As seal member 133 is compressed, the foam sealing material deforms over any roughness remaining in depression D1 to provide a leak proof seal between blade housing segment B and planar member 102, preventing leakage from access opening O. To the extent possible, the roughness in depression D1 has been smoothed, but some roughness ordinarily remains. When tightened, screws 124 and wedge shape blocks 122 cooperate with recess 110, in which peripheral edge R of housing B extends, to retain planar member 102 in a sealing relationship against blade housing B.

Figure 11:
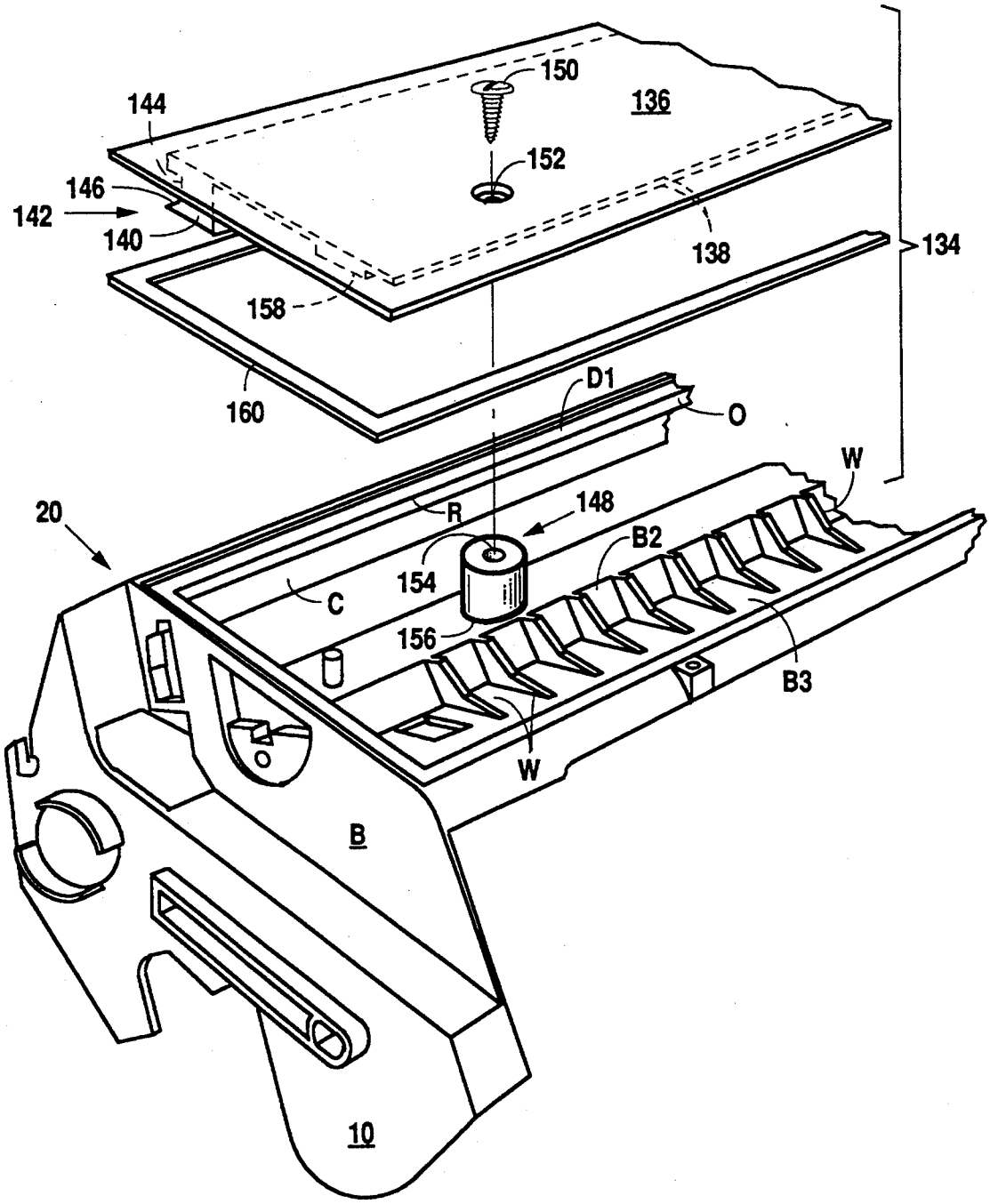
FIG. 11 is an exploded pictorial view illustrating a second embodiment of the removable lid apparatus according to the present invention.

Referring to FIG. 11, a second embodiment of the removable lid assembly of the present invention is illustrated generally as 134. Removable lid assembly includes an elongated, generally planar member 136 similar to planar member 102. Similarly, planar member 136 is provided with a peripheral, generally rectangularly shaped recess, which is similar to recess 104, and which is similarly defined by a rectangularly shaped land, illustrated by phantom lines 138. Likewise, planar member 136 is provided with an elongated prop member portion 140, which is similar to prop member 108. An elongated recess 142 similar to recess 110 is formed between planar member 136 and prop member 140. Recess 142 has a shaped cross section similar to shaped cross section 112 into which rearward facing, peripheral edge portion R is inserted. Similarly, the shaped cross section of recess 142 facilitates rotating planar member 136 downward over access opening O. The shaped cross section of recess 142 is likewise defined by a pair of intersecting, elongated, flattened surfaces 144, 146 similar to transverse intersecting surface 114 and angular intersecting surface 116. Similarly, recess 142 is therefore provided with a shaped cross section, which facilitates rotating planar member 136 downward over access opening O.

Fastening means are provided adjacent the side of planar member 136 opposite elongated recess 142 for removably fastening planar member 136 to blade housing segment B. In this embodiment, the fastening means includes a plurality of thickened members which may be provided in the form of generally cylindrically shaped posts 148, and a plurality of fasteners, which may similarly be provided in the form of screws 150 similar to screws 124, and which extend through a plurality of spaced, counterbored holes 152 formed in planar member 136, to engage bores 154 in posts 148. The number of posts 148, screws 150 and counterbored holes 152 may be two, although other numbers of posts 148, screws 150, and holes 152 such as three may be provided instead. Similarly, counterbored holes 152 receive the heads of screws 150, so that planar member 136 is provided with a flush surface.

Each post 148 is provided with an angular, flattened lower surface 156, which abuts against bottom B3 of cavity H. Angular lower surface 156 allows posts 148 to be arranged within cavity H generally perpendicular to planar member 136. After positioning posts 148 in cavity H with their bores 154 aligned with holes 152, posts 148 may similarly be attached or bonded to bottom B3 of blade housing segment B by suitable means such as gluing or heat bonding. Once posts 148 are attached to blade housing segment B, screws 150 may engage bores 154 to removably fasten planar member 136 over access opening O. Again, planar member 136 may be provided with an elongated spacer strip, illustrated by phantom lines 158, which is similar to spacer strip 130. As illustrated, spaced holes 152 extend through spacer strip 158, which fills any gap between formed between posts 148 and planar member 136, thus reducing the thickness of planar member 136.

Seal means provided in the form of a lightweight foam seal member 160 similar to foam seal member 133 is disposed in the peripheral recess, which extends along the peripheral edge of planar member 136. As screws 150 are tightened, planar member 136 compresses seal member 160 in sealing area depression D1. As seal member 160 is compressed, the foam sealing material deforms over any roughness remaining in depression D1 to provide a leak proof seal between blade housing segment B and planar member 136, preventing leakage from access opening O. When tightened, screws 150 and posts 148 cooperate with recess 142, in which peripheral edge R of housing B extends, to retain planar member 136 in a sealing relationship against blade housing B.

Now with the development of the reusable seal assembly 100 or 134, removal of the original access opening sea covering access opening O during refurbishment or remanufacturing of process unit 20 allows blade housing segment B to be more easily reutilized. Ordinarily, this may be accomplished by removing the Original access opening seal covering the access opening O of blade housing segment B. A flattened screwdriver may be utilized to remove the original access opening seal. After removal of the original access opening seal, the roughness in depression D1 is smoothed to the extent possible utilizing sandpaper, and cavity H cleaned of residual developer. Cleaning blade 4 may also be removed and serviced or replaced. After cleaning cavity H, and servicing cleaning blade 4, thickened members in the form of wedge shaped blocks 122 or posts 148 may be positioned in cavity H and attached to blade housing segment B as described hereafter.

Utilizing the fastening means embodiment illustrated in FIGS. 1–10, wedge shaped blocks 122 are inserted through access opening O into cavity H of blade housing segment B. Counting from the end of cavity H, the angular slot 132 of each wedge shaped block 122 is aligned over, for example, the fifth web-like member W5. Once positioned, each wedge shaped block 122 is slid downward until the lower face of wedge shaped block 122 contacts against bottom B3. As each wedge shaped block 122 moves downward, the corresponding web-like member W5 slides into slot 132, and wedge shaped blocks 122 are accordingly spaced within cavity H with their bores 128 aligned below holes 126 in planar member 102. In this manner, web-like members W and slots 132 cooperate to align thickened members 122 below holes 126, so that fasteners in the form of screws 124 may engage bores 128 in wedge shaped blocks 122. Wedge shaped blocks 122 may be attached or bonded within cavity H to blade housing segment B by suitable means such as gluing or heat bonding.

Utilizing the fastening means embodiment illustrated in FIG. 11, posts 148 are inserted through access opening O into cavity H of blade housing segment B. Each post 148 is provided with an angular, flattened lower surface 156, which abuts against bottom B3 of cavity H, allowing posts 148 to be arranged within cavity H generally perpendicular to planar member 136. After, for example, utilizing holes 152 in planar member 136 to position posts 148 in cavity H such that their bores 154 are aligned with holes 152, posts 148 may similarly be attached or bonded to blade housing segment B by suitable means such as gluing or heat bonding. Once posts 148 are attached to blade housing segment B, screws 150 may engage bores 154 to removably fasten planar member 136 over access opening O.

Hereafter, the utilization of planar member 102 to cover access opening O will be described, noting the utilization of planar member 136, screws 150 and seal member 160 to cover access opening O is similar. After inserting rearward facing, peripheral edge portion R into elongated recess 110, planar member 102 may be rotated downward over access opening O. As rearward facing, peripheral edge portion R is inserted into recess 110, angular flattened surface 116 mates generally against concave cross section C. As may be appreciated, obtuse angle 120 aids in inserting peripheral edge portion R into recess 110. As planar member 102 is rotated downward to cover access opening O, intersecting surfaces 114, 116 pivot about edge portion R. As planar member 102 rotates downward, angular surface 116 slides against concave cross section C. Shaped cross section 112, therefore, facilitates rotating planar member 102 downward over access opening O.

After lowering planar member 102 over access opening O, screws 124 may be inserted through holes 126 in planar member 102 to engage bores 128. As screws 124 are tightened, planar member 102 compresses seal member 133 against depression D1. As seal member 133 is compressed, the foam sealing material deforms over any roughness remaining in depression D1 to provide a leak proof seal between blade housing segment B and planar member 102, preventing leakage from access opening O. When process unit 20 needs additional servicing or refurbishment due to exhaustion of developer T, screws 124 may be removed, i allowing planar member 102 to be removed for cleaning cavity H of blade housing segment B and servicing cleaning blade 4.

Figure 12:
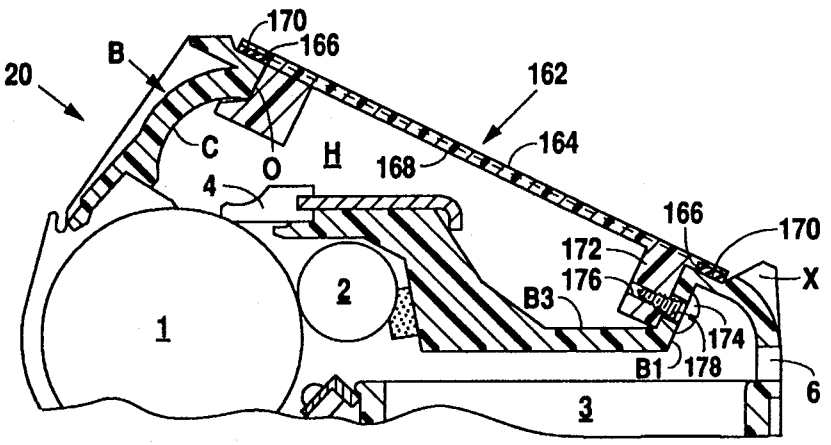
FIG. 12 is a cut-away side view illustrating a third embodiment of the removable lid apparatus according to the present invention.
Figure 13:
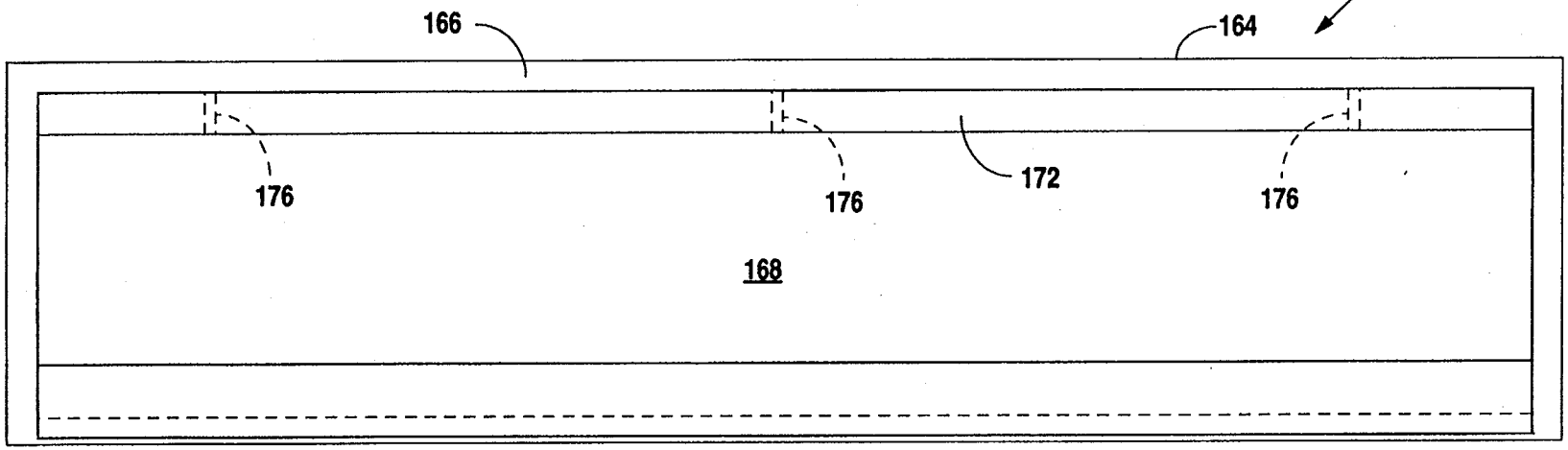
FIG. 13 is a bottom view of the removable lid apparatus embodiment illustrated in FIG. 12.

Referring to FIGS. 12 and 13, a third embodiment of the removable lid apparatus according to the present invention is illustrated generally as 162. Removable lid assembly 162 comprises an elongated, generally planar member 164. Planar member 164 preferably comprises a generally rigid, thin member, which may be molded or formed or cut from a sheet of a suitable plastic such as polycarbonate. Planar member 164 may be provided with upper and lower flattened surfaces. Of course, ridges, ribs or the like may be formed along one or both surfaces of planar member 164 to increase the rigidity of planar member 164. Given the dimensions of peripheral sealing area depress on D1 surrounding access opening O, the dimensions of the generally rigid planar member 164 should be approximately equal to the following values: length 9 13/16 inches (24.924 centimeters), width 2 13/32 inch (6.112 centimeters), and ⅛ inch (0.318 centimeter) thickness. For the purposes of illustration only, these values have been greatly distorted in the Figures.

The lower surface of planar member 164 is provided with a peripheral, generally rectangularly shaped recess 166, defined by rectangularly shaped land 168. Generally, the dimensions of recess 166 are as follows: width approximately 3/16 inches (0.476 centimeter), and depth approximately 1/16 inches (0.159 centimeter). Seal means provided in the form of a lightweight foam seal member 170 similar to foam seal member 133 or 160 is disposed in peripheral recess 166, which extends along the peripheral edge of planar member 164.

An elongated skirt 172 extends generally transversely downward from, and across land 168. Skirt 172 may be formed integral with planar member 164 by suitable means such as extrusion. Skirt 172 is arranged to contact against the interior face of sidewall B1. A plurality of fasteners in the form of screws 174 are provided for removably fastening planar member 164 over access opening O, which are received in a plurality of transverse bores 176 in skirt 172. Screws 174 extend through apertures 178 in sidewall B1 to engage transverse bores 176. Removal of the original access opening seal covering access opening O during refurbishment or remanufacturing of process unit 20, as described generally above, allows access to cavity H so that apertures 178 may be drilled through sidewall B1.

The location of apertures 178 and transverse bores 174 is such that when screws 174 engage bores 176, planar member 164 compresses seal member 170 against depression D1. As seal member 170 is compressed, the foam sealing material deforms over any roughness remaining in depression D1 to provide a leak proof seal between blade housing segment B and planar member 164, preventing leakage from access opening O. When screws 174 are tightened, planar member 164 is retained in a sealing relationship against blade housing B. When process unit 20 needs additional servicing or refurbishment due to exhaustion of developer T, screws 174 may be removed, allowing planar member 164 to be removed for cleaning cavity H of blade housing segment B and servicing cleaning blade 4.

Figure 14:
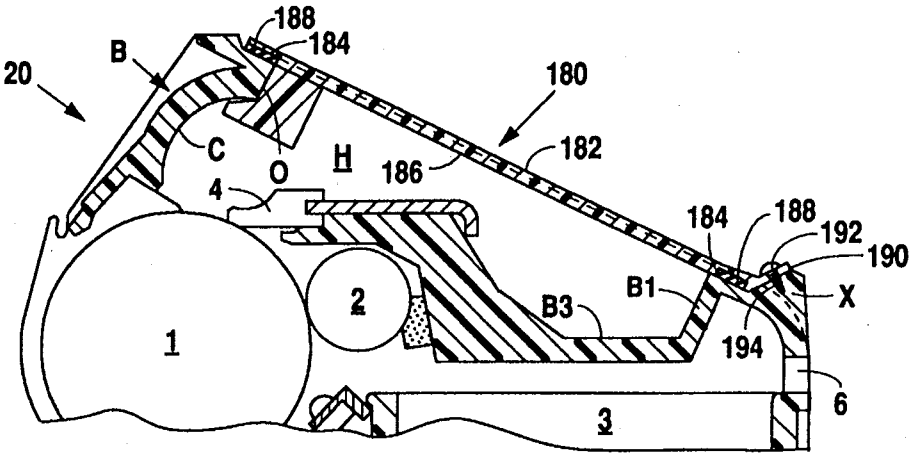
FIG. 14 is a cut-away side view illustrating another embodiment of the removable lid apparatus according to the present invention.
Figure 15:
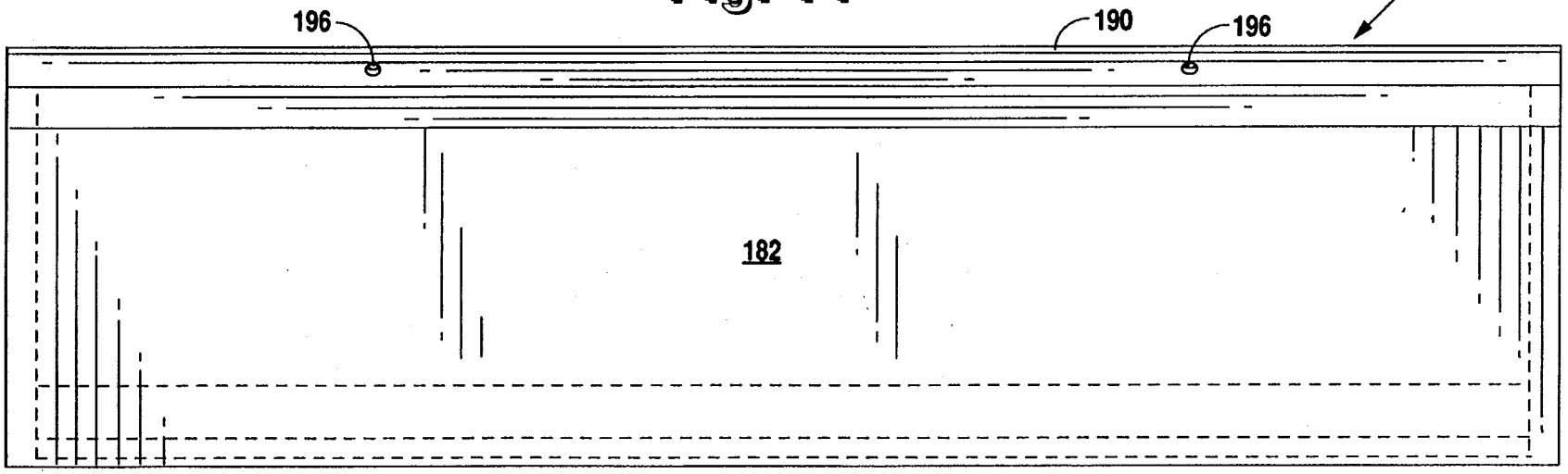
FIG. 15 is a top view of the removable lid apparatus embodiment illustrated in FIG. 14.

Referring to FIGS. 14 and 15, another embodiment of the removable lid apparatus according to the present invention is illustrated generally as 180. Removable lid assembly 180 comprises an elongated, generally planar member 182. Planar member 182 preferably comprises a generally rigid, thin member, which may be molded or formed or cut from a sheet of a suitable plastic such as polycarbonate. Planar member 182 may be provided with upper and lower flattened surfaces. Of course, ridges, ribs or the like may be formed along one or both surfaces of planar member 182 to increase the rigidity of planar member 182. Given the dimensions of peripheral sealing area depression D1 surrounding access opening O, the dimensions of the generally rigid planar member 182 should be approximately equal to the following values: length 9 13/16 inches (24.924 centimeters), width 2 13/32 inch (6.112 centimeters), and ⅛ inch (0.318 centimeter) thickness. For the purposes of illustration only, these values have been greatly distorted in the Figures.

The lower surface of planar member 182 is provided with a peripheral, generally rectangularly shaped recess 184, defined by rectangularly shaped land 186. Generally, the dimensions of recess 184 are as follows: width approximately 3/16 inches (0.476 centimeter), and depth approximately 1/16 inches (0.159 centimeter). Seal means provided in the form of a lightweight foam seal member 188 similar to foam seal member 133, 160 or 170 is disposed in peripheral recess 184, which extends along the peripheral edge of planar member 182.

An elongated skirt 190 extends angularly upward from the rearward peripheral edge of planar member 182, generally at an obtuse angle such as 127 degrees. Skirt 190 may be formed integral with planar member 182 by suitable means such as molding or extrusion. Skirt 190 is arranged to contact against rearward lip X of blade housing segment B. A plurality of fasteners in the form of screws 192 are provided for removably fastening planar member 182 over access opening O, which are received in a plurality of spaced bores 194 formed in lip X of blade housing segment B, and which may be provided before or after removal of the original access opening seal. Screws 192 extend through spaced apertures 196 in skirt 190 to engage bores 194. As illustrated in FIG. 15, the number of screws 192 and corresponding bores 194 and apertures 196 may total two.

The location of apertures 196 and bores 194 is such that when screws 192 engage bores 194, planar member 182 compresses seal member 188 against depression D1. As sea member 188 is compressed, the foam sealing material deforms over any roughness remaining in depression D1 to provide a leak proof seal between blade housing segment B and planar member 182, preventing leakage from access opening O. When screws 192 are tightened, planar member 182 is retained in a sealing relationship against blade housing B. When process unit 20 needs additional servicing or refurbishment due to exhaustion of developer T, screws 192 may be removed, allowing planar member 182 to be removed for cleaning cavity H of blade housing segment B and servicing cleaning blade 4.

As various changes can be made in the above described embodiments without departing from the spirit and scope of the invention, it is intended that all matter contained in the above description or shown in the accompanying drawings shall he interpreted as illustrative and not in a limiting sense.

What is claimed is:

1. Removable lid apparatus for covering the access opening of a blade housing segment of a developer cartridge, the blade housing segment containing an elongated cleaning blade and having a cavity therein intersecting with the access opening, said removable lid apparatus comprising:

an elongated, generally planar member having portions thereon defining an elongated recess along one edge portion thereof into which a peripheral edge portion defining said access opening is inserted;

a plurality of spaced, thickened members fastened in said cavity of said blade housing;

a plurality of spaced fasteners disposed on said planar member over said thickened members to releasingly engage said thickened members and removably attach said planar member to said thickened members; and seal means along the peripheral edge of said planar member for sealing against said blade housing.

2. Removable lid apparatus of claim 1, wherein said thickened members comprises a number of spaced post portions, each of which is fastened in said cavity of said blade housing.

3. Removable lid apparatus of claim 2, wherein said planar member includes a plurality of spaced holes therein and wherein said fasteners comprise a plurality of screws positionable in said holes in said planar member, and wherein said post portions are positioned in said cavity below said holes in said planar member, each post portion having a bore therein aligned with one of said holes in said planar member to receive one of said screws.

4. Removable lid apparatus of claim 1, wherein said blade housing segment further comprises a series of spaced, but transverse, flat web-like members located in said cavity of said blade housing, and wherein said thickened members are elongated, each of said thickened member further having portions thereon defining a slot in which one of said transverse web-like members extends to locate and space said thickened members within said cavity.

5. Removable lid apparatus of claim 4, wherein said slots in said thickened members and said transverse web-like members cooperate to align said thickened members below said fasteners.

6. Removable lid apparatus of claim 4, wherein said planar member includes a plurality of spaced holes therein, and wherein said fasteners comprise a plurality of screws positionable in said holes in said planar member, and wherein said slot and said transverse web-like members cooperate to position said thickened members in said cavity below said holes in said planar member, each thickened member having a bore therein aligned with one of said holes in said planar member to receive one of said screws.

7. Removable lid apparatus of claim 1, wherein a peripheral edge defining said elongated recess has a shaped cross section therein to facilitate rotating said planar member downward over said access opening.

8. Removable lid apparatus of claim 7, wherein a portion of said peripheral edge portion defining said access opening has a concave cross section, and wherein said shaped cross section of said elongated recess is defined by a pair of intersecting surfaces, said pair of intersecting surfaces comprising an elongated, transverse flattened surface that is inset from, and which generally parallels a longitudinal edge portion of said planar member, said transverse flattened surface extending generally transversely across the longitudinal lower surface of said planar member; and an elongated, angular flattened surface that is spaced below the lower surface of said planar member, and which intersects said transverse flattened surface at an obtuse angle, said angular flattened surface extending across at least a portion of said transverse flattened surface.

9. Removable lid apparatus for covering the access opening of a blade housing segment of a developer cartridge, the blade housing segment containing an elongated cleaning blade and having a cavity therein intersecting with the access opening, said blade housing segment further comprising a series of spaced, but transverse, flat web-like members, said removable lid apparatus comprising:

an elongated, generally planar member having portions thereon defining an elongated recess along one edge portion thereof into which a peripheral edge portion defining said access opening is inserted;

a plurality of spaced, elongated thickened members fastened in said cavity of said blade housing, each of said thickened member having portions thereon defining a slot in which one of said transverse web-like members extends to locate and space said thickened members within said cavity;

a plurality of spaced fasteners disposed on said planar member over said thickened members to releasingly engage said thickened members and removably attach said planar member to said thickened members, said slots in said thickened members and said transverse web-like members cooperating to align said thickened members below said fasteners; and seal means along the peripheral edge of said planar member for sealing against said blade housing.

10. Removable lid apparatus of claim 9, wherein said planar member has a plurality of spaced holes therein, said fasteners comprising a plurality of screws positionable in said holes in said planar member, and each thickened member having a bore therein to receive one of said screws, and wherein said slots and said transverse web-like members cooperate to position said thickened members below said holes in said planar member and to align said holes over said bores in said thickened members.

11. Removable lid apparatus of claim 9, wherein a peripheral edge defining said elongated recess has a shaped cross section therein to facilitate rotating said planar member downward over said access opening.

12. Removable lid apparatus of claim 11, wherein a portion of said peripheral edge portion defining said access opening has a concave cross section, and wherein said shaped cross section of said elongated recess is defined by a pair of intersecting surfaces, said pair of intersecting surfaces comprising an elongated, transverse flattened surface that is inset from, and which generally parallels a longitudinal edge portion of said planar member, said transverse flattened surface extending generally transversely across the longitudinal lower surface of said planar member; and an elongated, angular flattened surface that is spaced below the lower surface of said planar member, and which intersects said transverse flattened surface at an obtuse angle, said angular flattened surface extending across at least a portion of said transverse flattened surface.

13. Remanufactured developing apparatus for developing an electrostatic latent image formed on an image bearing member, said remanufactured developing apparatus comprising:

a frame;

a developer container carried by said frame;

a developer supply chamber carried by said frame and formed adjacent to said developer container, said developer container having an outlet port connecting said developer container to said developer supply chamber;

a rotatable developer conveying member located in said developer container and arranged to convey developer from said developer container through said outlet port into said developer supply chamber;

a rotatable developing sleeve disposed within said developer supply container;

a blade housing segment disposed on said frame in a spaced relationship above said developer container to define a path therebetween, said blade housing segment having a cavity therein, and an access opening therein intersecting with said cavity;

a rotatable electrophotographic photosensitive member carried near, but spaced from, said rotatable developing sleeve in a forward portion of said frame generally between said blade housing and said developer supply chamber, said path between said blade housing segment and said developer chamber connecting with a slitlike exposure window in a rear portion of said frame to provide an optical path connecting with said photosensitive member;

a charger for charging said photosensitive member wherein by the projection of a laser beam, an electrostatic latent image is formed on said photosensitive member;

a cleaning blade located in said housing and having a peripheral edge contacting against said photosensitive member to remove residual developer remaining on said photosensitive member after image transfer, said cavity for retaining the residual developer, said access opening providing access to said cleaning blade and said cavity to remove the residual developer;

a developer amount regulating blade extending into said developer supply container in a contacting relationship against said developing sleeve to regulate the thickness of the layer of the developer applied on said developing sleeve so that the thickness of the layer is less than the minimum clearance between said photosensitive member and said developing sleeve; and a seal assembly including an elongated, generally planar member having portions thereon defining an elongated recess along one edge portion thereof into which a peripheral edge portion defining said access opening is inserted, said elongated recess having a shaped cross section therein to facilitate rotating said planar member downward over said access opening, said seal assembly including fastening means opposite said elongated recess for removably fastening said planar member to said blade housing, and seal means along the peripheral edge of said planar member for sealing against said blade housing, said fastening means and said elongated recess cooperating to retain said planar member in a sealing relationship against said blade housing.

14. Remanufactured developing apparatus of claim 13, wherein said fastening means includes:

a plurality of spaced post portions fastened in said cavity of said blade housing; and a plurality of fasteners releasingly attaching said planar member to said post portions.

15. Remanufactured developing apparatus of claim 14, wherein said fasteners are a plurality of screws, and wherein said post portions are bored to receive said screws.

16. Remanufactured developing apparatus of claim 13, wherein said unused developing apparatus further comprises a series of spaced, but transverse, flat web-like members in said cavity of said blade housing, and wherein said fastening means includes:

a plurality of elongated thickened members fastened in said cavity, each thickened member having portions thereon defining a slot in which one of said transverse web-like members extends to locate and space said thickened members within said cavity; and a plurality of spaced fasteners releasingly attaching said planar member to said thickened members, said slots in said thickened members and said transverse web-like members cooperating to align said thickened members below said fasteners.

17. Remanufactured developing apparatus of claim 16, wherein said fasteners are a plurality of screws located in a plurality of spaced holes in said planar member, and wherein said thickened members are bored to receive said screws, said slots in said thickened members and said transverse web-like members cooperating to align the bores of said thickened members below said holes in said planar member to receive said screws located in said holes.

18. Remanufactured developing apparatus of claim 13, wherein said peripheral edge portion defining said access opening has a concave cross section, and wherein said shaped cross section of said elongated recess is defined by a pair of intersecting surfaces, said pair of intersecting surfaces comprising an elongated, transverse flattened surface that is inset from, and which generally parallels a longitudinal edge portion of said planar member, said transverse flattened surface extending generally transversely across the longitudinal lower surface of said planar member; and an elongated, angular flattened surface that is spaced below the lower surface of said planar member, and which intersects said transverse flattened surface at an obtuse angle, said angular flattened surface extending across at least a portion of said transverse flattened surface.

19. Remanufactured developing apparatus for developing an electrostatic latent image formed on an image bearing member, said remanufactured developing apparatus comprising:

a frame;

a developer container carried by said frame;

a developer supply chamber carried by said frame and formed adjacent to said developer container, said developer container having an outlet port connecting said developer container to said developer supply chamber;

a rotatable developer conveying member located in said developer container and arranged to convey developer from said developer container through said outlet port into said developer supply chamber;

a rotatable developing sleeve disposed within said developer supply container;

a blade housing segment disposed on said frame in a spaced relationship above said developer container to define a path therebetween, said blade housing segment having a cavity therein, and an access opening therein intersecting with said cavity;

a rotatable electrophotographic photosensitive member carried near, but spaced from, said rotatable developing sleeve in a forward portion of said frame generally between said blade housing and said developer supply chamber, said path between said blade housing segment and said developer chamber connecting with a slitlike exposure window in a rear portion of said frame to provide an optical path connecting with said photosensitive member;

a charger for charging said photosensitive member wherein by the projection of a laser beam, an electrostatic latent image is formed on said photosensitive member;

a cleaning blade located in said housing and having a peripheral edge contacting against said photosensitive member to remove residual developer remaining on said photosensitive member after image transfer, said cavity for retaining the residual developer, said access opening providing access to said cleaning blade and said cavity to remove the residual developer;

a developer amount regulating blade extending into said developer supply container in a contacting relationship against said developing sleeve to regulate the thickness of the layer of the developer applied on said developing sleeve so that the thickness of the layer is less than the minimum clearance between said photosensitive member and said developing sleeve;

a seal assembly including an elongated, generally planar member configured to cover said access opening, and a skirt portion associated with said planar member which is arranged to contact against said blade housing, said seal assembly including fastening means for removably fastening said skirt portion to said blade housing, and seal means along the peripheral edge of said planar member for sealing against said blade housing, said fastening means drawing said planar member against said blade housing to compress said seal means between said planar member and said blade housing.

20. Remanufactured developing apparatus of claim 19, wherein said skirt extends generally transversely across said planar member, said skirt being configured to contact against an interior wall portion defining said cavity, and wherein said fastening means removably fastens said skirt portion to said interior wall portion defining said cavity.

21. Remanufactured developing apparatus of claim 19, wherein said skirt extends angularly upward and generally at an obtuse angle from a longitudinal peripheral edge portion of said planar member, said skirt being configured to contact against an external lip portion formed on said blade housing segment, and wherein said fastening means removably fastens said skirt portion to said external lip portion.

22. A method of installing a replaceable sealing assembly comprising an elongated, generally planar member in a used developing station wherein the developing station comprises a blade housing segment having an access opening formed by the removal of the original access opening seal, said blade housing segment having a cavity therein connecting with said access opening and a cleaning blade disposed in said cavity, said developing station also having a developer container and a developer supply chamber joined along the common edges of the developer container and developer supply chamber, wherein the developer supply chamber includes a roller assembly and a metering blade assembly; whereby the used developing station can be converted into a rechargeable developing station; wherein, the method comprises the steps of:

removing the original access opening seal covering the access opening of the blade housing segment;

inserting a number of thickened members through the access opening into the cavity of the blade housing segment;

attaching the thickened members in a spaced relationship in said cavity of said blade housing segment;

inserting a peripheral edge portion defining said access opening into an elongated recess formed along one edge portion of said planar member;

rotating said planar member downward to cover said access opening; and releasably fastening said planar member to said thickened members to compress a seal element surrounding the periphery of said planar member against the blade housing to seal the access opening.

* * * * *